US009918157B2

(12) United States Patent
Kamada et al.

(10) Patent No.: US 9,918,157 B2
(45) Date of Patent: Mar. 13, 2018

(54) HEADPHONE TYPE ACOUSTIC APPARATUS AND CONTROL METHOD THEREFOR

(71) Applicant: SONY CORPORATION, Tokyo (JP)

(72) Inventors: Jo Kamada, Tokyo (JP); Atsuto Ohashi, Tokyo (JP); Asako Kawamura, Tokyo (JP); Yasuhiro Onogi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/912,086

(22) PCT Filed: Jun. 24, 2014

(86) PCT No.: PCT/JP2014/003381

§ 371 (c)(1),
(2) Date: Feb. 12, 2016

(87) PCT Pub. No.: WO2015/022765

PCT Pub. Date: Feb. 19, 2015

(65) Prior Publication Data

US 2016/0205459 A1 Jul. 14, 2016

(30) Foreign Application Priority Data

Aug. 13, 2013 (JP) ..... 2013-168300

(51) Int. Cl.

| | |
|---|---|
| ***H04R 1/10*** | (2006.01) |
| ***H04R 29/00*** | (2006.01) |
| *H04R 3/12* | (2006.01) |
| *H04R 5/033* | (2006.01) |

(52) U.S. Cl.
CPC ..... *H04R 1/1041* (2013.01); *H04R 29/001* (2013.01); *H04R 1/1008* (2013.01);
(Continued)

(58) Field of Classification Search
CPC .. H04R 1/1041; H04R 5/033; H04R 2420/07; H04R 5/04; H04R 1/1066; H04R 1/105;
(Continued)

(56) References Cited

U.S. PATENT DOCUMENTS

2006/0159279 A1* 7/2006 Kuo ..... H04R 1/1041 381/74
2008/0166002 A1* 7/2008 Amsel ..... H04R 1/025 381/370

(Continued)

FOREIGN PATENT DOCUMENTS

| | | | |
|---|---|---|---|
| JP | 2000-316198 | A | 11/2000 |
| JP | 2008-141691 | A | 6/2008 |
| JP | 2010-074831 | A | 4/2010 |

*Primary Examiner* — Akelaw Teshale
(74) *Attorney, Agent, or Firm* — Chip Law Group

(57) ABSTRACT

This headphone type acoustic apparatus includes a pair of housing blocks each including a headphone unit, a headband section that supports the housing blocks at both ends and includes a pair of speaker units, one or more sensors that obtain information for estimating a mounted state achieved by a user, and a control unit that estimates the mounted state based on outputs of the one or more sensors and controls, based on the estimated mounted state, outputs of the pair of headphone units and the pair of speaker units.

10 Claims, 14 Drawing Sheets

(52) U.S. Cl.
CPC ..... *H04R 1/1066* (2013.01); *H04R 1/1075* (2013.01); *H04R 3/12* (2013.01); *H04R 5/033* (2013.01); *H04R 2420/03* (2013.01); *H04R 2430/01* (2013.01)

(58) Field of Classification Search
CPC ..... H04R 5/0335; H04R 1/025; H04R 1/026; H04R 2205/021; H04R 1/1008; H04R 1/1083; H04R 1/1091; H04R 2201/107; H04R 2499/11; H04R 1/08; H04R 1/10; H04R 2201/01
USPC ..... 381/74, 370, 71.6, 310, 379, 309, 374, 381/375, 376, 378, 107, 184, 186, 311, 381/335, 366, 367, 371, 372, 373, 380, 381/383, 58, 85
See application file for complete search history.

(56) References Cited

U.S. PATENT DOCUMENTS

| | | | | |
|---|---|---|---|---|
| 2014/0064500 | A1* | 3/2014 | Lee | H04R 1/1041 381/58 |
| 2014/0192994 | A1* | 7/2014 | Chen | H04R 1/1083 381/71.6 |
| 2016/0080853 | A1* | 3/2016 | Chen | H04R 1/1041 381/74 |
| 2016/0182995 | A1* | 6/2016 | Kamada | H04R 1/1075 381/373 |
| 2016/0366507 | A1* | 12/2016 | Hou | H04R 1/1041 |

* cited by examiner

HEADPHONE TYPE ACOUSTIC APPARATUS AND CONTROL METHOD THEREFOR

TECHNICAL FIELD

The present technology relates to a headphone type acoustic apparatus integrally including headphones and speaker used for listening to music and to a control method therefor.

BACKGROUND ART

Most headphones are of so-called closed type. The headphones of this type is an acoustic apparatus configured to produce optimal sound in closed spaces between headphone units and ears. In contrast, a speaker is designed to be used for listening to sound at some distance. The headphones and the speaker are structurally similar. It can be said that the most important difference therebetween is power (sound pressure) for vibrating air. The headphones only need to have power for vibrating air in the closed spaces. On the other hand, the speaker needs high power for vibrating air in a space between the speaker and the user.

Patent Document 1 has disclosed headphones in which the output power of a headphone/speaker is switched between a low level for the headphone and a high level for the speaker by a changeover switch operation. Thus, the headphones have both of headphone and speaker functions.

However, the headphones of Patent Document 1 merely switch the output power of the speaker unit placed in a housing between the low level for the headphone and the high level for the speaker. Therefore, for using the speaker unit as the speaker, it has to be used as a stationary speaker. At this time, a distance between speaker units respectively placed in left and right housings is not sufficient for providing a sufficient stereophonic effect in stereophonic reproduction.

Patent Document 1: Japanese Patent Application Laid-open No. 2010-74831 (paragraph [0019], etc.)

SUMMARY OF INVENTION

Problem to be solved by the Invention

Regarding a headphone type acoustic apparatus integrally including headphones and a speaker, it has been desirable to improve the performance, for example, the usability and the sound quality of the speaker.

In view of the above-mentioned circumstances, it is an object of the present technology to improve the performance of a headphone type acoustic apparatus integrally including headphones and a speaker.

Means for solving the Problem

In order to solve the above-mentioned problem, a headphone type acoustic apparatus according to the present technology includes a pair of housing blocks each including a headphone unit, a headband section that supports the housing blocks at both ends and includes a pair of speaker units, one or more sensors that obtain information for estimating a mounted state achieved by a user, and a control unit that estimates the mounted state based on outputs of the one or more sensors and controls, based on the estimated mounted state, outputs of the pair of headphone units and the pair of speaker units.

The control unit may determine, according to the estimated mounted state, whether the outputs of the pair of headphone units are turned on or the outputs of the pair of speaker units are turned on.

The estimated mounted state may include a first mounted state achieved by engagement with at least the pair of housing blocks and the headband section, and a second mounted state achieved by engagement with the headband section, and the control unit may turn on at least the pair of headphone units when the first mounted state is estimated and turn on at least the pair of speaker units when the second mounted state is estimated.

The control unit may turn on both of the pair of speaker units and the pair of headphone units when the second mounted state is estimated.

The detection section may include one or more pressure sensors and one or more motion sensors that are provided in a site that is capable of being brought into contact with the user in the pair of housing blocks and a site that is capable of being brought into contact with the user in the headband section in the first mounted state, and the control unit may estimate the mounted state based on detection results of the one or more pressure sensors and the one or more motion sensors.

The control unit may make the output of the headphone unit larger than the output on the first mounted state for a certain time period after termination of the first mounted state is estimated, and gradually reduce the output after the certain time period has elapsed.

The control unit may estimate, based on the detection results of the one or more pressure sensors and the one or more motion sensors, a first installed state in which the headphone type acoustic apparatus self-stands on the pair of housing blocks, and turn on the pair of speaker units.

The control unit may estimate, based on the detection results of the one or more pressure sensors and the one or more motion sensors, a second installed state in which the headphone type acoustic apparatus is suspended with the headband section being a supporting point, and turn on the pair of speaker units.

A control method for a headphone type acoustic apparatus that is another aspect of the present technology includes preparing a pair of housing blocks each including a headphone unit, a headband section that supports the housing blocks at both ends and includes a pair of speaker units, and one or more sensors that obtain information for estimating a mounted state achieved by a user, and estimating, by a control unit, the mounted state based on outputs of the one or more sensors and controlling, based on the estimated mounted state, outputs of the pair of headphone units and the pair of speaker units.

Effects of the Invention

As described above, according to the present technology, it is possible to improve the performance of a headphone type acoustic apparatus integrally including headphones and a speaker.

MODE(S) FOR CARRYING OUT THE INVENTION

Hereinafter, an embodiment to which the present technology is applied will be described with reference to the drawings.

<First Embodiment>

[Configuration of Headphone Type Acoustic Apparatus]

Figure 1:
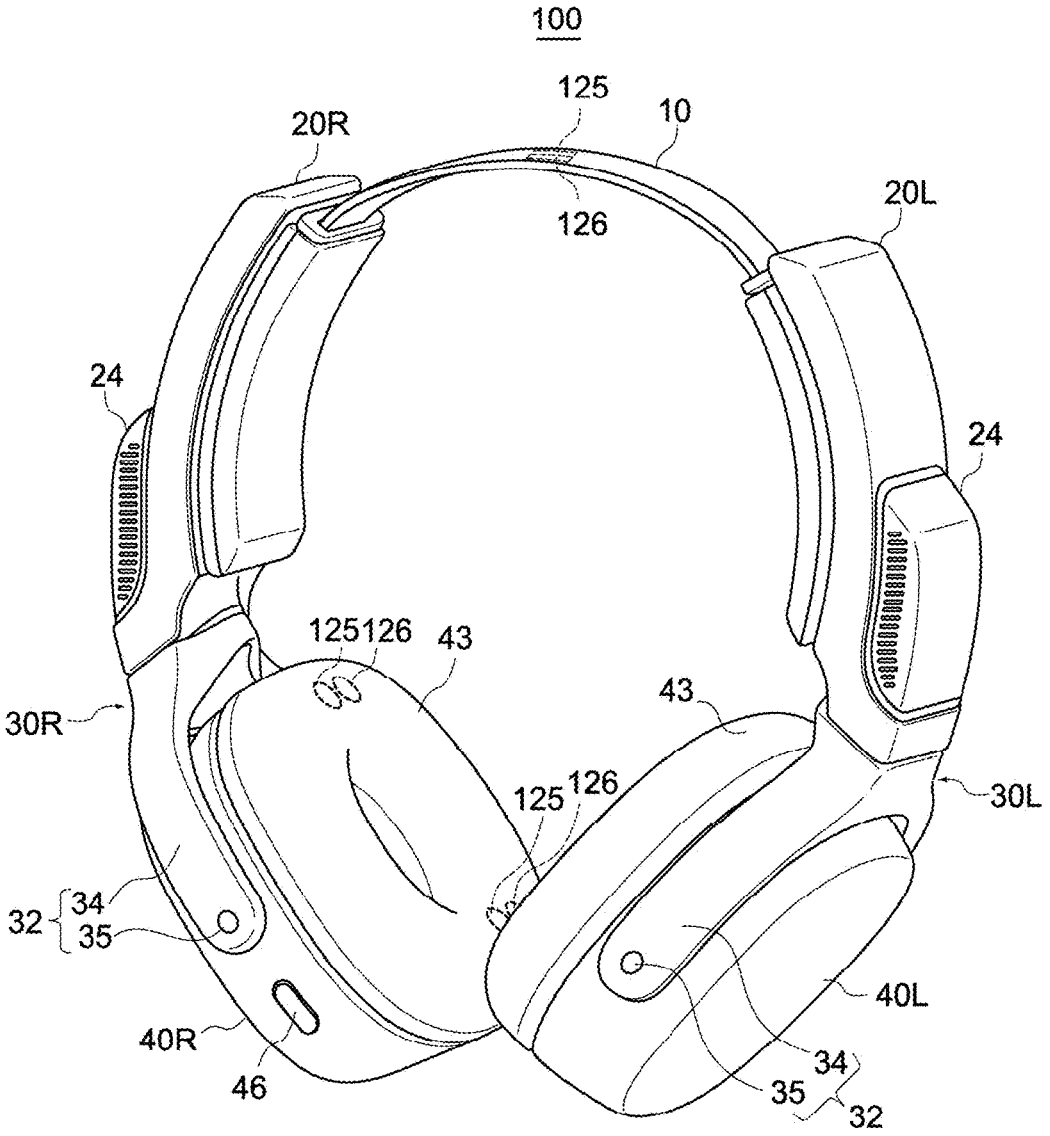
FIG. 1 A diagram showing the outer appearance of a headphone type acoustic apparatus of a first embodiment according to the present technology.

FIG. 1 is a diagram showing the outer appearance of a headphone type acoustic apparatus of a first embodiment according to the present technology. As shown in the figure, a headphone type acoustic apparatus 100 includes a headband 10, left and right slider blocks 20R, 20L, left and right hangers 30R, 30L, and left and right housing blocks 40R, 40L.

Note that the symbol "R" indicates the right, the symbol "L" indicates the left, and the left and right are directions as viewed from a user wearing the headphone type acoustic apparatus 100.

For hanging the headband 10 on the head or neck of a human body, the headband 10 is, for example, formed of a flexible thin plate of synthetic resin that is generally curved at an approximately predetermined curvature. The housing blocks 40R, 40L are attached to both ends of the headband 10 via the slider blocks 20R, 20L and the hangers 30R, 30L, respectively. Note that the headband 10 and the left and right slider blocks 20R, 20L are collectively referred to as a "headband section" in the scope of claims.

Figure 2:
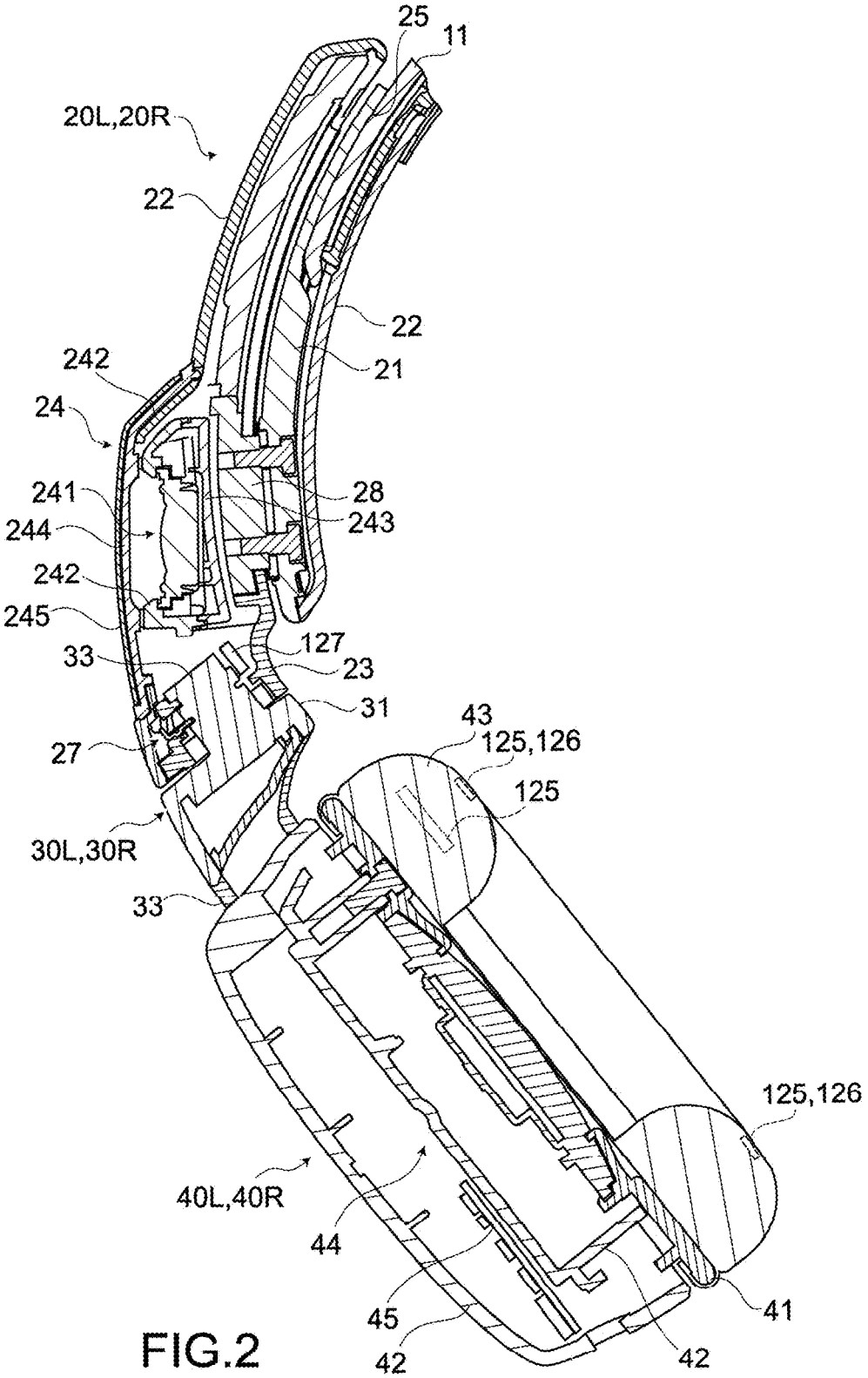
FIG. 2 A sectional view showing a configuration of the headphone type acoustic apparatus of FIG. 1.

FIG. 2 is a sectional view showing a configuration of the headphone type acoustic apparatus 100 of FIG. 1.

Each of the slider blocks 20R, 20L includes a slider base 21, a slider cover 22, a hanger coupling portion 23, and a speaker unit 24.

For slidably retaining an end portion 11 of the headband 10, the slider base 21 includes an insertion portion 25, a hooking structure (not shown), and the like. The end portion 11 of the headband 10 is inserted into the insertion portion 25. The hooking structure is provided in the insertion portion 25 and locks an insertion position of the headband 10 by hooking a hooking portion (not shown) such as a protrusion formed on a surface of the end portion 11 of the headband 10. By manually adjusting the amount of insertion of the end portion 11 of the headband 10 depending on needs, the user can fit the housing blocks 40R, 40L onto the left and right ears of the user.

The slider cover 22 is an outer packaging cover for the slider base 21.

The hanger coupling portion 23 is a portion coupled to the hangers 30R, 30L to be described later.

To each of the slider blocks 20R, 20L, fixed is the speaker unit 24 including a group of parts necessary for the headphone type acoustic apparatus 100 of this embodiment to function as a speaker. The term "speaker" as used herein means an acoustic apparatus that transmits sound to the user by vibrating air in a surrounding open space. It is used herein as a term having different meaning from the "headphones" that transmit sound to the user by vibrating air in a space closed by the housing blocks.

The hanger 30R, 30L includes a first coupling portion 31 for coupling to the hanger coupling portion 23 of the slider block 20R, 20L and a second coupling portion 32 (see FIG. 1) for coupling to the housing block 40R, 40L. The first coupling portion 31 includes a shaft portion 33. This shaft portion 33 is coupled to a bearing portion 27 provided in the hanger coupling portion 23 of the slider block 20R, 20L. The bearing portion 27 is a part for rotatably retaining the shaft portion 33 of the first coupling portion 31 of the hanger 30R, 30L. By the shaft portion 33 of the first coupling portion 31 of the hanger 30R, 30L being coupled to the bearing portion 27 of the hanger coupling portion 23 of the slider block 20R, 20L in this manner, the hanger 30R, 30L is coupled to the slider block 20R, 20L to be rotatable around the shaft.

Note that the first coupling portion 31 including the shaft portion 33 is provided integrally with the hanger 30R, 30L, and hence sufficient durability is provided.

On the other hand, the second coupling portions 32 (see FIG. 1) of the hangers 30R, 30L rotatably support the housing blocks 40R, 40L, respectively. This second coupling portion 32 is configured to enable the housing block 40R, 40L to rotate in an axis direction orthogonal to the axis direction of the shaft portion 33 in the above-mentioned first coupling portion 31. The second coupling portion 32 includes a forked portion 34 provided extending from the vicinity of the first coupling portion 31 in a forked state and shaft portions 35 provided in distal ends of the forked portion 34.

The shaft portions 35 are provided protruding from surfaces of the forked portion 34 which are opposed to a housing 42 of the housing block 40R, 40L. The shaft portions 35 of each of the left and right hangers 30R, 30L are arranged to be aligned in a single straight line passing through the center of the housing 42 and substantially function as an integral shaft. The shaft portions 35 of each of the left and right hangers 30R, 30L are inserted into bearing holes (not shown) formed in the housing 42 and retained.

[Configurations of Housing Blocks 40R, 40L]

Next, configurations of the housing blocks 40R, 40L will be described.

Each of the housing blocks 40R, 40L includes a baffle 41, the housing 42, an ear pad 43, a headphone unit 44, a wiring board 45, and the like.

The baffle 41 includes a base material having an approximately disk shape that fixes the housing 42, the ear pad 43, and the headphone unit 44.

The housing 42 is a box having an approximately cylindrical shape for covering the headphone unit 44.

The ear pad 43 is a part having an approximately doughnut shape having cushion properties for covering the ear of the user.

Note that the shapes of the baffle 41, the housing 42, and the ear pad 43 are not limited to the above.

The headphone unit 44 is constituted of a diaphragm for converting electrical signals into vibration of air (sound), a magnetic circuit (e.g., magnet and voice coil), and the like.

The wiring board 45 is a board on which an integrated circuit necessary for realizing the functions of a processor 110, a memory, and otherwise an audio reproduction apparatus and other electronic components are mounted.

Note that, for example, in the housing 42, provided are a slide switch 46 that is a part of a user operation section 114 (see FIG. 8) and otherwise switches such as a push switch and a jog dial.

[Configuration of Speaker Unit]

Next, a configuration of the speaker unit 24 will be described.

In the headphone type acoustic apparatus 100 of this embodiment, the speaker units 24 are provided as devices that output sound in addition to the headphone units 44 in the housing blocks 40R, 40L.

The speaker units 24 are disposed in the left and right slider blocks 20R, 20L, respectively. The speaker unit 24 is provided in a predetermined surface of the slider block 20R, 20L, that is, a surface oriented outward when the headphone type acoustic apparatus 100 is worn by being hung on the head or neck of the user.

Figure 3:
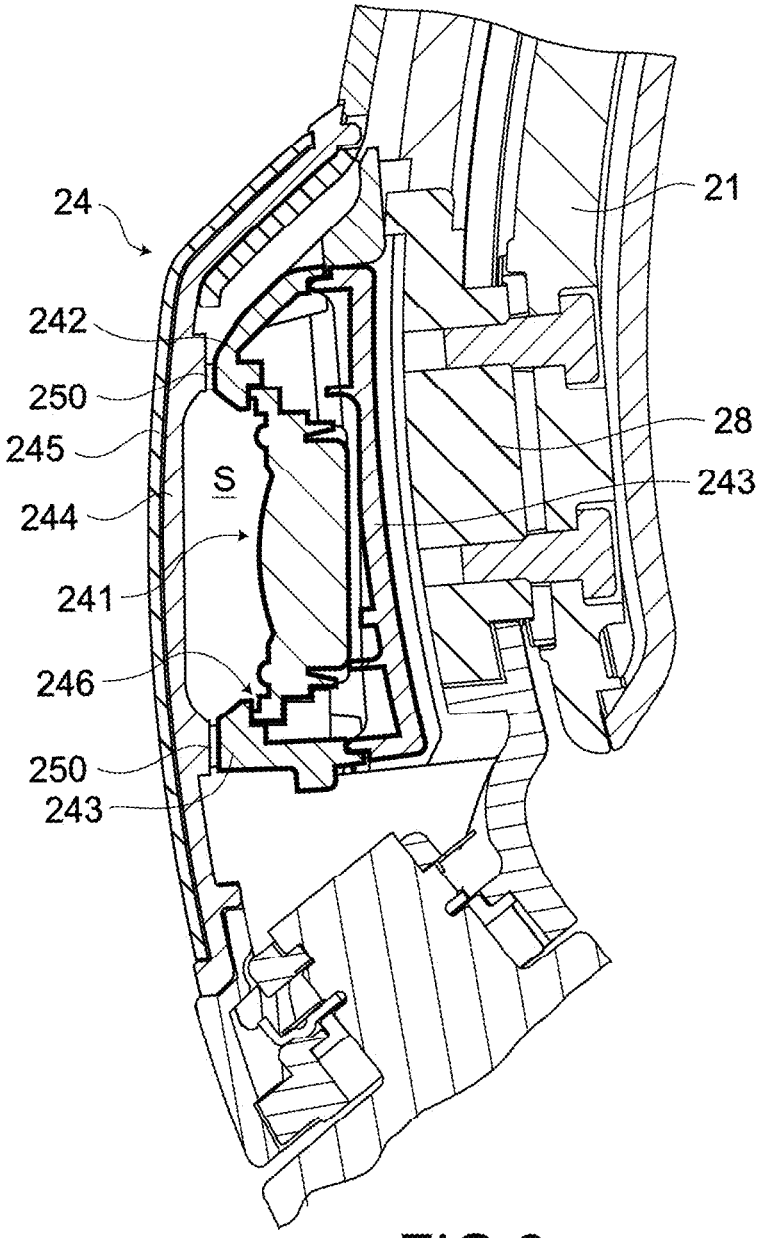
FIG. 3 A longitudinal sectional view of a speaker unit.
Figure 4:
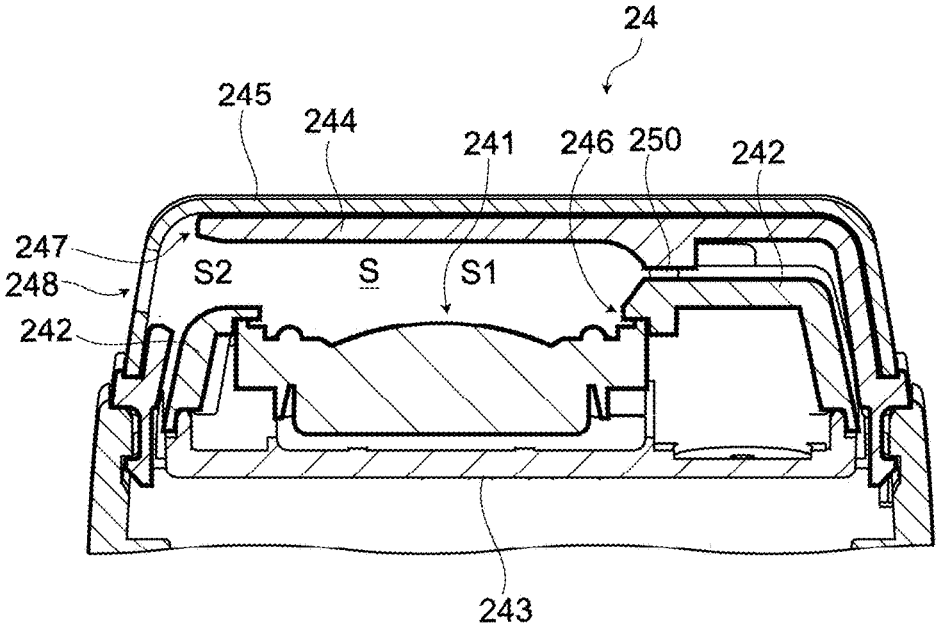
FIG. 4 A transverse sectional view of the speaker unit.
Figure 5:
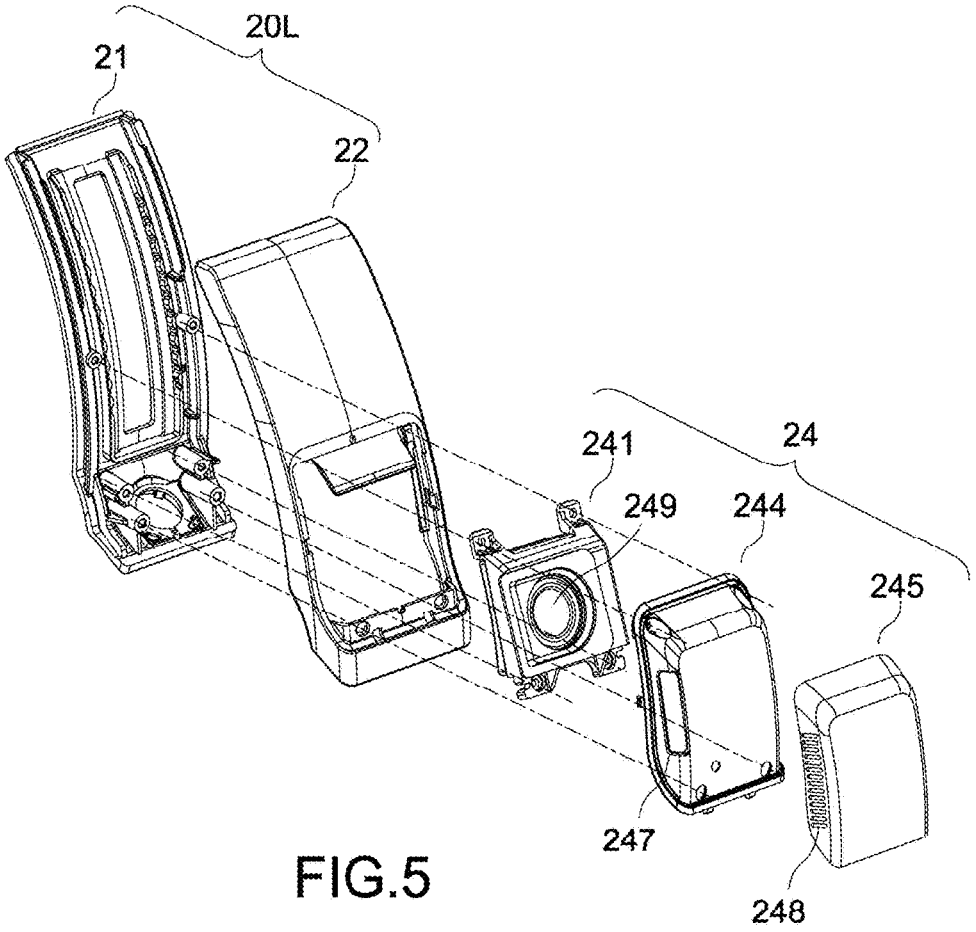
FIG. 5 An outer appearance view showing a configuration of a speaker unit 24 from which a cover and the like are removed.

FIG. 3 is a longitudinal sectional view showing the configuration of the speaker unit 24. FIG. 4 is a transverse sectional view of the speaker unit 24. FIG. 5 is an exploded perspective view showing a part of a configuration of the slider block 20R, 20L including the speaker unit 24.

The speaker unit 24 includes a diaphragm for converting electrical signals into vibration of air (sound), a magnetic circuit (e.g., magnet and voice coil) that drives the diaphragm, a speaker driver unit 241 that is constituted of cases 242, 243 and the like that house them, and a speaker cover 244 and a speaker grille 245 that constitute a lid of the speaker driver unit 241.

The cases 242, 243 are constituted of an upper case 242 and a lower case 243. In the upper case 242, a diaphragm retaining aperture 246 for retaining the periphery of the diaphragm in a state in which the diaphragm (249 in FIG. 5) is exposed is provided. The cases 242, 243 are fixed to a cushion member 28 fixed to the slider base 21 of the slider block 20R, 20L, via coupling parts such as a screw.

The speaker cover 244 is attached above the speaker driver unit 241 so as to form a space between the diaphragm of the speaker driver unit 241 and the surface of the upper case 242.

The speaker grille 245 is a cover part for decoration that further covers the outside of the speaker cover 244.

As shown in FIGS. 3 and 4, a space S is formed between the diaphragm of the speaker driver unit 241 and the surface of the upper case 242 and the speaker cover 244. In order to emit a sound pressure with a predetermined directivity from the inside to the outside of the space S, a sound spill port 247 for spilling sound from the space to the outside is provided in a side surface of the speaker cover 244. In addition, in the speaker grille 245 that covers the outside of the speaker cover 244, formed is a slit opening 248 correspondingly to the sound spill port 247 of the speaker cover 244. The sound pressure output from the speaker driver unit 241 is emitted from the inside to the outside of the space S through the sound spill port 247 provided in the side surface of the speaker cover 244 and the slit opening 248 of the speaker grille 245. In other words, in the lid that collectively refers to the speaker cover 244 and the speaker grille 245, a region in which openings of the sound spill port 247 and the slit opening 248 overlap each other is provided as substantially an opening for spilling sound from the inside to the outside.

Furthermore, such that sound emitted from the diaphragm of the speaker driver unit 241 is smoothly guided to the sound spill port 247 provided in the side surface of the speaker cover 244 and emitted to the outside through them, the speaker cover 244 and the upper case 242 are configured as follows.

1. A most part of a rear surface of the speaker cover 244 (surface opposed to diaphragm and surface of upper case 242) is occupied by a flat surface.

2. The height position of the space S and the height position of the sound spill port 247 were set to be approximately the same.

3. The space S was stopped at a position along a semicircumference on an opposite side of the sound spill port 247 of the speaker driver unit 241. That is, as viewed from a vibration direction of the diaphragm, the space S is constituted of a space portion S1 corresponding to an outer shape of the diaphragm and a space portion S2 that communicates from the space portion S1 to the sound spill port 247 of the speaker cover 244.

In order to configure the space S to have a close structure except for the sound spill port 247, portions in which the surface of the upper case 242 and the rear surface of the speaker cover 244 abut against each other are pressure-welded to each other while sandwiching a cushion sheet 250 therebetween. Note that the cushion sheet 250 serves to prevent vibration of the upper case 242 due to vibration of the diaphragm from being transmitted to the speaker cover 244.

By the way, the side surface in which the sound spill port 247 of the speaker cover 244 is provided means a surface oriented forward in a state in which the headphone type acoustic apparatus 100 is worn by the user. In other words, the sound spill port 247 is provided in an end of the space S, which is in a direction orthogonal to a slide direction of the slider block 20R, 20L. The reason is as follows.

Figure 6:
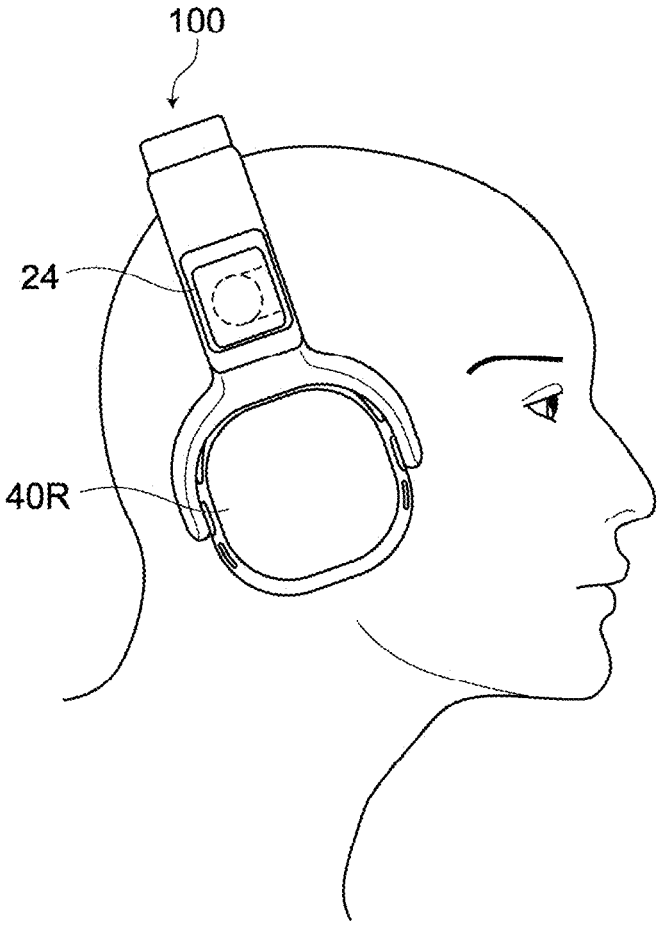
FIG. 6 A diagram showing a head-mounted state of the headphone type acoustic apparatus of this embodiment.

Mainly two kinds of mounted state of the headphone type acoustic apparatus 100 of this embodiment are assumed. One of them is, as shown in FIG. 6, a mounted state during general use of the headphones. Specifically, it is a state in which the left and right housing blocks 40R, 40L are put on the left and right ears of the user. It will be referred to as a "head-mounted state."

Figure 7:
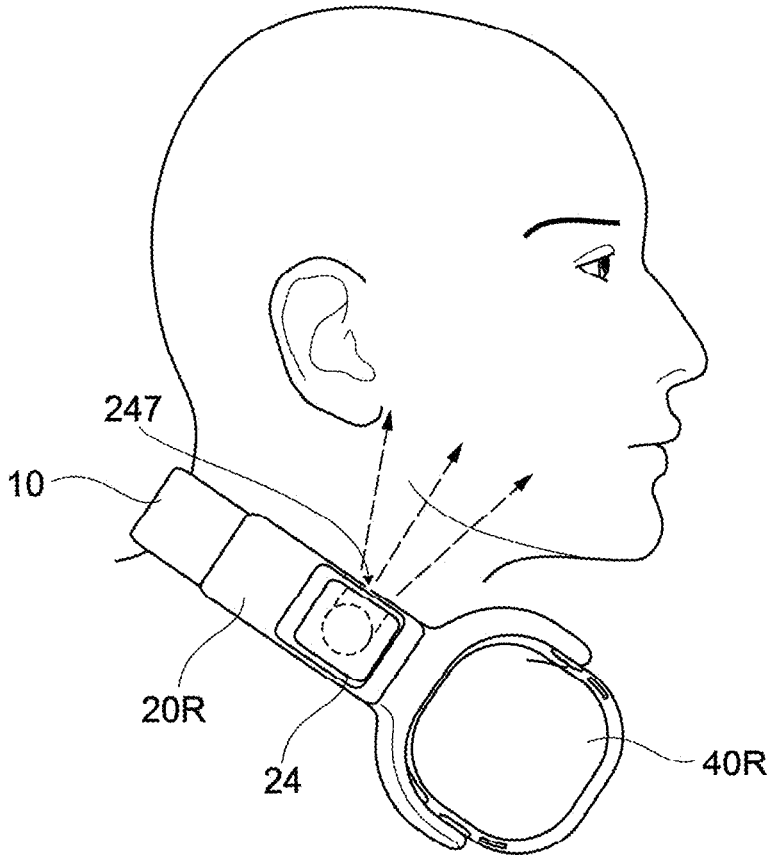
FIG. 7 A diagram showing a neck-mounted state of the headphone type acoustic apparatus of this embodiment.

The other is, for example, as shown in FIG. 7, a state in which the portion of the headband 10 and the left and right slider blocks 20R, 20L is mounted by being hung on the neck of the user. It will be referred to as a "neck-mounted state." In this neck-mounted state, the sound spill ports 247 of the left and right speaker units 24, 24 are located approximately directly under the left and right ears of the user. At this time, the sound spill ports 247 are oriented upward and forward. With this, sound from the left and right speaker units 24, 24 efficiently reaches the left and right ears of the user.

Furthermore, as shown in FIG. 3, the lower case 243 of the speaker unit 24 is fixed and supported to the slider base 21 via the cushion member 28 with the screw or the like. With this, vibration of the speaker unit 24 is prevented from being transmitted to the slider base 21 of the slider block 20R, 20L.

[Electrical Configuration of Headphone Type Acoustic Apparatus 100]

Figure 8:
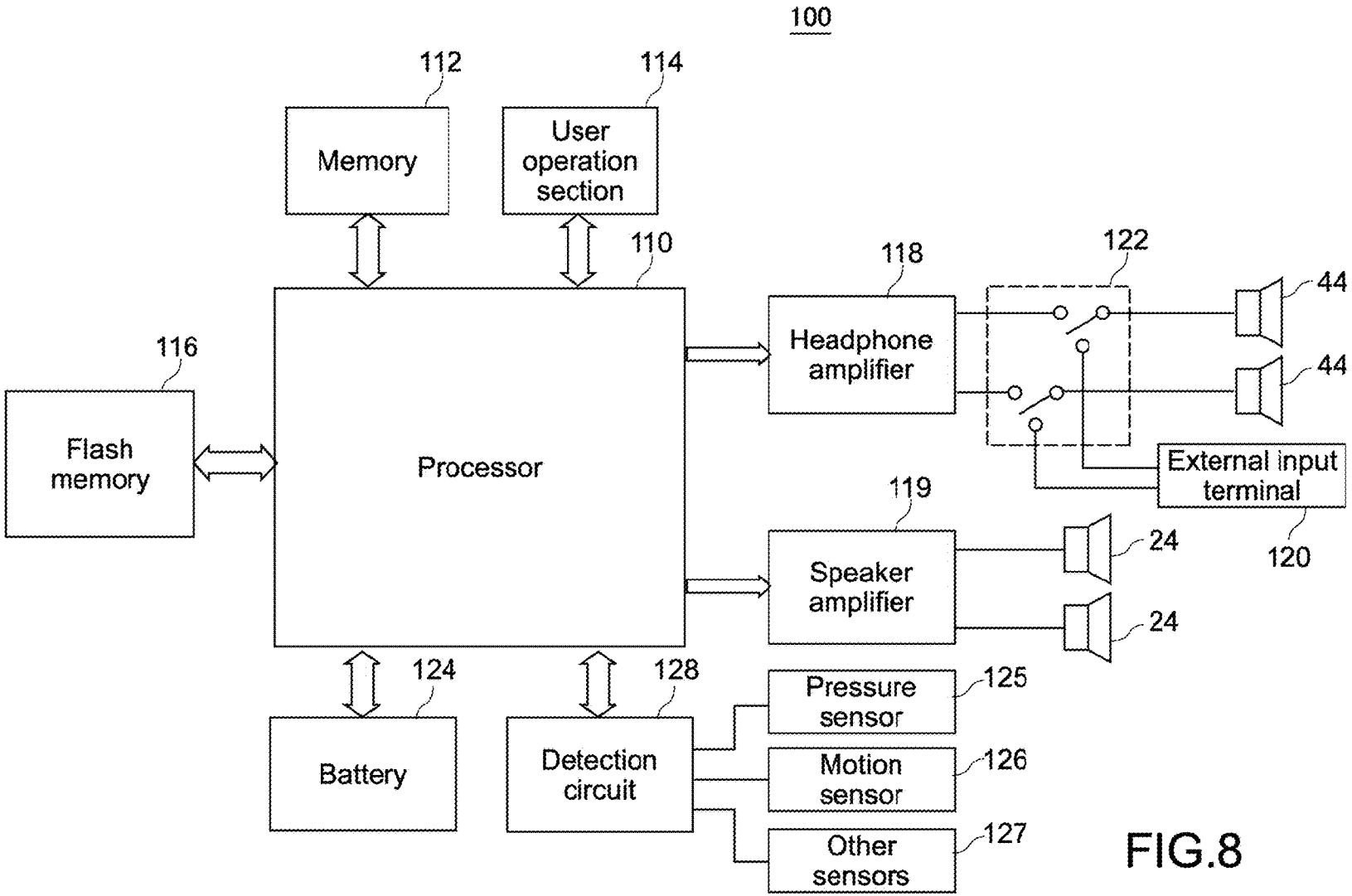
FIG. 8 A diagram showing an electrical configuration of the headphone type acoustic apparatus of this embodiment.

FIG. 8 is a diagram showing an electrical configuration of the headphone type acoustic apparatus 100 of this embodiment.

As shown in the figure, the headphone type acoustic apparatus 100 includes the processor 110, a memory 112, the user operation section 114, a flash memory 116, a headphone amplifier 118, a speaker amplifier 119, the headphone units 44, 44, the speaker units 24, 24, an external input terminal 120, a switching circuit 122, a battery 124, various sensors 125, 126, 127, a detection circuit 128, and the like.

The processor 110 is a control circuit that performs entire control and necessary arithmetic processing and signal processing of the headphone type acoustic apparatus 100 of this embodiment and is constituted of a BGA (Ball Grid Array) and the like.

The memory 112 stores a program and the like to be executed by the processor 110 and is used as a working area of the processor 110 or the like. The memory 112 is constituted of an SDRAM (Synchronous Dynamic Random Access Memory) and the like.

The user operation section 114 is a device that receives an input of an operation from the user, for example, a jog dial, a slide switch, or a push button.

As switches of the user operation section 114, there are on/off switch of a main power source, a sound volume switch, an output changeover switch, and the like. The output changeover switch is a switch for alternatively switching between a headphone output and a speaker output.

The processor 110 detects the state of the output changeover switch and recognizes, based on the result, which of the headphone output and the speaker output has been selected by the user. If it is recognized that the headphone output has been selected by the user, the processor 110 drives the headphone units 44, 44 by bringing the headphone amplifier 118 into an active state. Furthermore, if it is recognized that the speaker output has been selected by the user, the processor 110 drives the speaker units 24, 24 by bringing the speaker amplifier 119 into an active state.

The flash memory 116 is a non-volatile storage device capable of rewriting and deleting, in which audio files and the like are stored as user data, for example.

The headphone amplifier 118 amplifies an audio signal output from the processor 110 and supplies it to the headphone units 44, 44.

The speaker amplifier 119 amplifies an audio signal output from the processor 110 and supplies it to the speaker units 24, 24.

The external input terminal 120 is a connection with an external device, for example, a smart phone or a portable audio device.

The switching circuit 122 switches, based on the connection state of the external device with the external input terminal 120, input sources of the headphone units 44, 44 between the headphone amplifier 118 and the external device. Specifically, if the external device is not connected to the external input terminal 120, the input sources of the headphone units 44, 44 are switched to the headphone amplifier 118. If the external device is connected to the external input terminal 120, the input sources of the headphone units 44, 44 are switched to the external device.

The battery 124 stores power for operating the headphone type acoustic apparatus 100 and supplies it. The battery 124 is rechargeable, for example, a lithium battery.

Sensors 125, 126, 127 are a sensor group for acquiring information for estimating a mounted state, an installed state, and the like of the headphone type acoustic apparatus 100. The sensors 125, 126, 127 will be described later in detail.

The detection circuit 128 is a circuit that detects each of outputs of the sensors 125, 126, 127 and supplies it as digital data to the processor 110. More specifically, for example, the detection circuit 128 extracts low-frequency components from the outputs of the sensors 125, 126, compares them with a predetermined threshold, for example, and outputs comparison results thereof as detection results or converts the output of the sensor 127 into the corresponding digital data and outputs it to the processor 110.

Otherwise, the headphone type acoustic apparatus 100 includes, although not shown in the figure, a display device such as an LED (Light Emitting Diode) for displaying various statuses, a general-purpose interface such as a USB (Universal Serial Bus), and the like.

[Basic Operation of Audio Reproduction]

Next, a basic operation of audio reproduction will be described.

When the user uses the user operation section 114 to instruct to reproduce a music track, the processor 110 reads in an audio file of the music track from the flash memory 116, for example. The processor 110 decodes and modulates it and converts it into an analog signal. The processor 110 supplies the analog audio signal to one of the headphone amplifier 118 and the speaker amplifier 119, which is set to an active state.

Here, a case where the headphone amplifier 118 is in an active state is assumed. The audio signal amplified by the headphone amplifier 118 is supplied to the headphone units 44, 44 and the headphone units 44, 44 are driven. With this, the user can enjoy music by the headphone output in the head-mounted state. Furthermore, in the case where the speaker amplifier 119 is in an active state, the processor 110 supplies the analog audio signal to the speaker amplifier 119. The audio signal amplified by the speaker amplifier 119 is supplied to the speaker units 24, 24 and the speaker units 24, 24 are driven. With this, the user can enjoy music by the speaker output.

Furthermore, while listening to music by the headphone output, the user can input an instruction to switch to the speaker output, via the user operation section 114. According to this instruction, the processor 110 switches the headphone amplifier 118 to an inactive state and switches the speaker amplifier 119 to an active state. The same applies to the case of switching from the speaker output state to the headphone output state.

In addition, in the headphone type acoustic apparatus 100 of this embodiment, it is possible to estimate the mounted state such as the head-mounted state and the neck-mounted state and automatically switch between the speaker output and the headphone output according to the estimated mounted state. This operation will be described later in detail.

As described above, in the headphone type acoustic apparatus 100 of this embodiment, in addition to the headphone units 44, 44 provided in the left and right housing blocks 40R, 40L, respectively, the speaker units 24, 24 are provided in the left and right slider blocks 20R, 20L. For enjoying music through the speaker units 24, 24, as shown in FIG. 7, the user is recommended to use it in the neck-mounted state through a product manual or the like. In this neck-mounted state, the sound spill ports 247 of the left and right speaker units 24, 24 are located approximately under the left and right ears of the user and oriented approximately upward. That is, sound from the left and right speaker units 24, 24 is emitted to the ears of the user from below. Therefore, without greatly increasing the sound volume of the speaker units 24, 24, the user can hear sound with sufficient volume.

Figure 9:
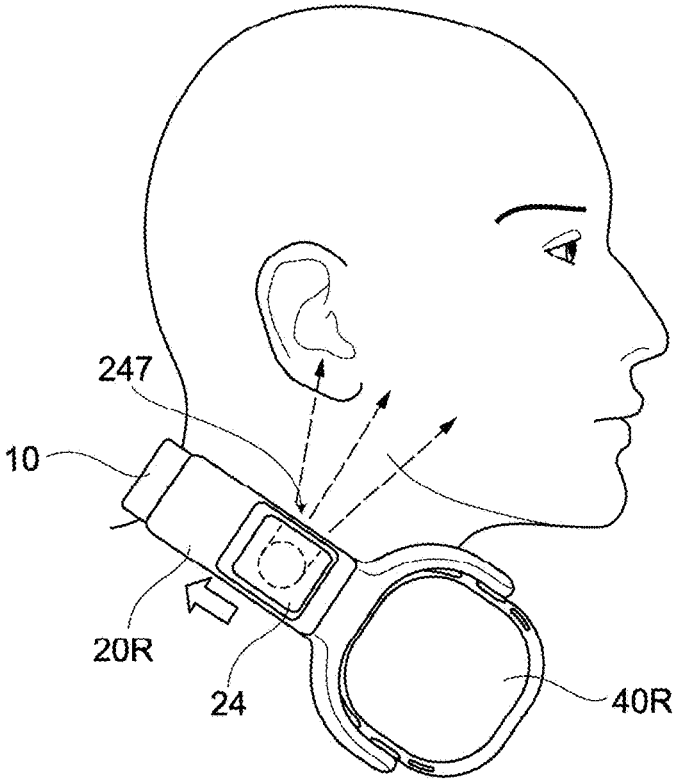
FIG. 9 A diagram showing a method of adjusting speaker positions.

In addition, the entire size of the headband 10 and the slider blocks 20R, 20L can be manually changed by the user depending on needs. Therefore, for example, as shown in FIG. 9, the position relationship between the left and right ears of the user and the left and right speaker units 24, 24 can be freely adjusted by changing the locking position to a position at which the headband 10 is slightly pulled out of the slider blocks 20R, 20L or changing the locking position to a position at which the headband 10 is slightly pushed into the slider blocks 20R, 20L conversely.

Furthermore, during use of the speaker, the ears are not closed unlike use of the headphones, and hence the user can hear surrounding sound as well as music. Therefore, the safety of the moving user can be enhanced.

[Configurations of Sensors]

Next, the sensors 125, 126, 127 of the headphone type acoustic apparatus 100 of this embodiment will be described.

In the headphone type acoustic apparatus 100 of this embodiment, the following one or more sensors 125, 126, 127 are provided.

1. Pressure sensors 125
2. Motion sensors 126
3. Other sensors (rotation detection sensors 127, acceleration sensors, etc.)

The pressure sensor 125 is a sensor for detecting that a pressure is applied from a human body (head, neck, etc.) of the user or an external object. The plurality of pressure sensors 125 are, for example, as shown in FIG. 1, arranged near the top of the headband 10, for example, and in the ear pads 43 of the left and right housing blocks 40R, 40L, for example.

The motion sensor 126 is a sensor for detecting a physical parameter of temperature, capacitance, or light, for example, and a change thereof and detecting contact or proximity of the human body of the user. For example, when an increase of the temperature, an increase of the capacitance, or a change from a state in which light is not reflected to a state in which light is reflected is detected, it is detected that the human body of the user is brought into contact with or comes closer to the sensor. The plurality of motion sensors 126 are, for example, as shown in FIG. 1, arranged near the top of the headband 10, for example, and in the ear pads 43 of the left and right housing blocks 40R, 40L, for example.

The outputs of the sensors 125, 126, 127 are collected by the detection circuit 128. The detection circuit 128 extracts low-frequency components from the output of each of the pressure sensors 125 and compares it with a threshold. The detection circuit 128 outputs a comparison result (large/small determination result) of the output with the threshold as a detection result to the processor 110. Furthermore, the detection circuit 128 extracts low-frequency components from the output of each of the motion sensors 126 and compares it with the threshold. The detection circuit 128 outputs a comparison result (large/small determination result) of the output with the threshold as a detection result to the processor 110. In addition, the detection circuit 128 converts outputs of the other sensors, for example, the rotation detection sensors 127 that detect rotation positions of the housing blocks 40R, 40L, into digital data of the corresponding rotation positions and outputs them to the processor 110.

[Control Based on Detection Results of Sensors]

In the headphone type acoustic apparatus 100 of this embodiment, switch control of the headphone output and the speaker output based on the detection results of the sensors will be described.

First, the following is assumed as the mounted state and the installed state of the headphone type acoustic apparatus 100 of this embodiment.

1. Head-mounted state
2. Neck-mounted state
3. Desktop state
4. Wall-hanging state FIG. 10 is a diagram showing the head-mounted state.

Note that, in the following description, depending on needs, a pressure sensor provided near the top of the headband 10, for example, will be referred to as a "pressure sensor 125A," and a plurality of pressure sensors mounted on the ear pads 43 of the left and right housing blocks 40R, 40L, for example, will be referred to as "pressure sensors 125B" and "pressure sensors 125C," a motion sensor provided near the top of the headband 10, for example, will be referred to as a "motion sensor 126A," and a plurality of motion sensors mounted on the ear pads 43 of the left and right housing blocks 40R, 40L, for example, will be referred to as "motion sensors 126B" and "motion sensors 126C."

First, an operation in the case of the head-mounted state will be described.

Figure 10:
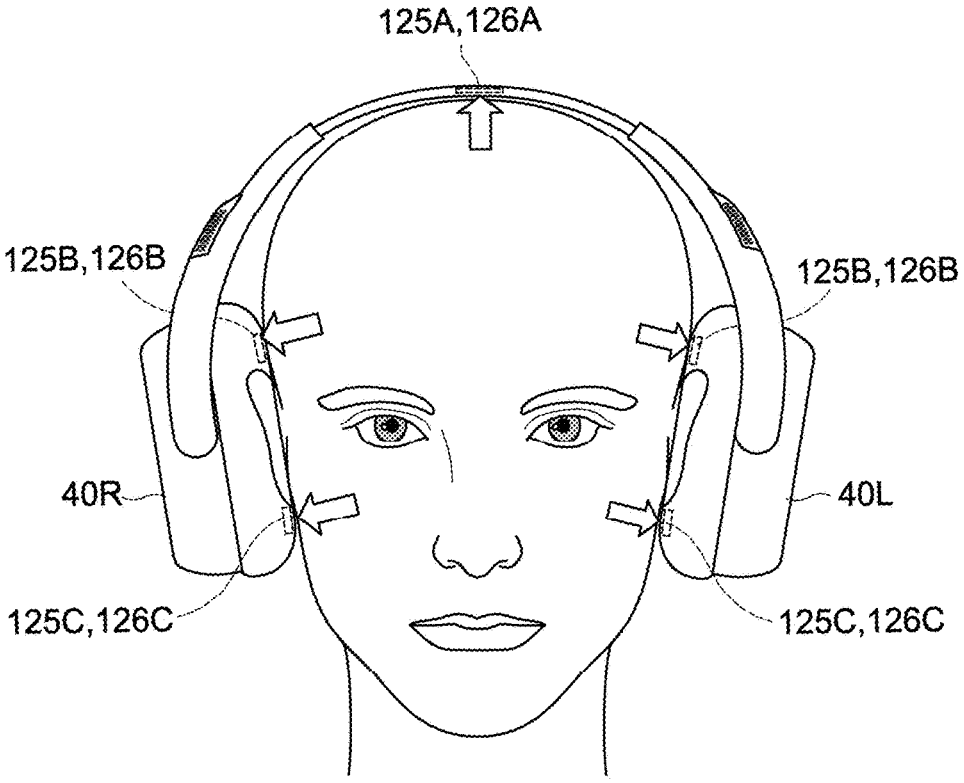
FIG. 10 A diagram showing a head-mounted state of the headphone type acoustic apparatus of FIG. 1.

As shown in FIG. 10, in the head-mounted state, the plurality of pressure sensors 125A, 125B, 125C provided near the top of the headband 10, for example, and in the ear pads 43 of the left and right housing blocks 40R, 40L, for example, and the detection circuit 128 detect generation of pressures. Detection results thereof are output to the processor 110. It is assumed that a detection result if generation of a pressure is detected is "ON." Furthermore, at this time, the plurality of motion sensors 126A, 126B, 126C provided near the top of the headband 10, for example, and in the ear pads 43 of the left and right housing blocks 40R, 40L, for example, and the detection circuit 128 detect occurrence of contact or proximity of the human body. Detection results thereof are output to the processor 110. It is assumed that a detection result if occurrence of contact or proximity of the human body is detected is "ON."

The processor 110 estimates, based on the detection results, that the mounted state of the headphone type acoustic apparatus 100 is the head-mounted state and brings the headphone amplifier 118 into an active state.

Note that, if the speaker output is performed immediately before it, the speaker amplifier 119 is brought into an inactive state and the headphone amplifier 118 is brought into an active state. With this, switching from the speaker output to the headphone output is performed.

Note that, in the description above, it is assumed that, if the detection results of the pressure sensors 125A, 125B, 125C and the detection results of the motion sensors 126A, 126B, 126C are all "ON," the headphone amplifier 118 is brought into an active state. However, if the detection results of the pressure sensors 125A, 125B, 125C are all "ON" or if the detection results of the motion sensors 126A, 126B, 126C are all "ON," the headphone amplifier 118 may be brought into an active state.

Next, an operation in the case of the neck-mounted state will be described.

Figure 11:
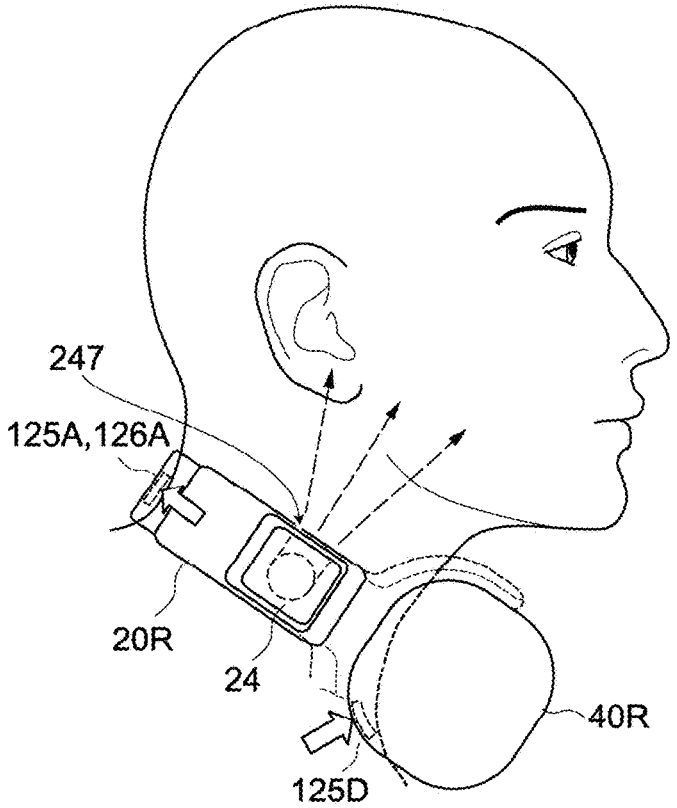
FIG. 11 A diagram showing a neck-mounted state of the headphone type acoustic apparatus of FIG. 1.

As shown in FIG. 11, in the neck-mounted state, the pressure sensor 125A provided near the top of the headband 10, for example, and the detection circuit 128 detect generation of pressures. Furthermore, at this time, the motion sensor 126A provided near the top of the headband 10, for example, detects occurrence of contact or proximity of the human body and detection results thereof are output to the processor 110.

By the way, in the neck-mounted state, a suitable direction for mounting the headphone type acoustic apparatus 100 is present. Specifically, if the sound spill ports 247 of the left and right speaker units 24, 24 are not oriented upward during mounting, it is difficult for the user to hear sound. In the headphone type acoustic apparatus 100 of this embodiment, pressure sensors 125D (see FIGS. 2 and 11) for determining whether the neck-mounted state in a correct direction is achieved is provided.

The pressure sensors 125D are provided at positions such that they are brought into contact with the breast portion of the user when the neck-mounted state in the correct direction is achieved. For example, they are provided in side surfaces of the ear pads 43 of the left and right housing blocks 40R, 40L, for example.

If generation of a pressure is detected by the pressure sensor 125A provided near the top of the headband 10, for example, occurrence of contact or proximity of the human body is detected by the motion sensor 126A, and generation of pressures is detected by the pressure sensors 125D, the processor 110 considers that the neck-mounted state in the correct direction is achieved and brings the speaker amplifier 119 into an active state.

Note that, if the headphone output is performed immediately before it, the headphone amplifier 118 is brought into an inactive state and the speaker amplifier 119 is brought into an active state. With this, switching from the headphone output state to the speaker output state is performed.

Figure 12:
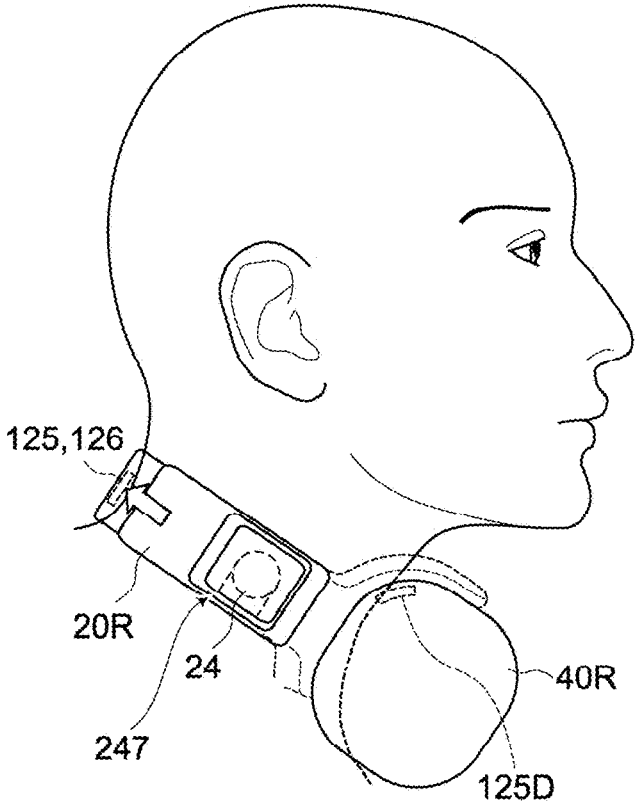
FIG. 12 A diagram showing a neck-mounted state in an incorrect direction.

Furthermore, for example, as shown in FIG. 12, if the neck-mounted state in an incorrect direction is achieved, generation of pressures is not detected by the pressure sensors 125D, and hence the processor 110 does not bring the speaker amplifier 119 into an active state. At this time, using synthetic sound, the processor 110 may inform the user to achieve the neck-mounted state in the correct direction.

Next, an operation in the case of the desktop state will be described.

Figure 13:
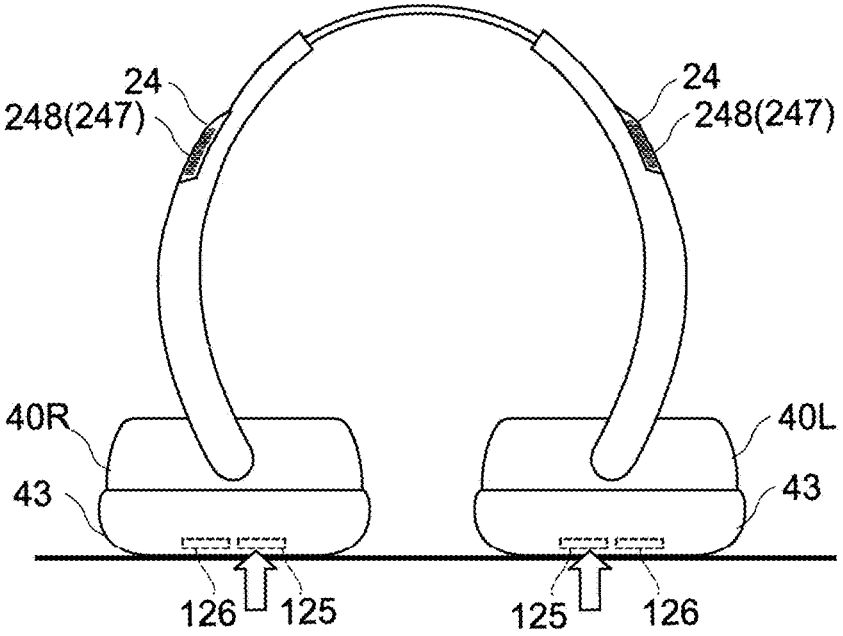
FIG. 13 A diagram showing a desktop state of the headphone type acoustic apparatus of FIG. 1.

As shown in FIG. 13, in the desktop state, in order to orient the sound spill ports 247 of the speaker units 24, 24 toward the user, the headphone type acoustic apparatus 100 is made to self-stand on a desk such that the ear pads 43 of the left and right housing blocks 40R, 40L are oriented downward (opposed to upper surface of desk), using the left and right housing blocks 40R, 40L as legs.

At this time, pressures are detected by all the pressure sensors 125 provided in the ear pads 43 of the left and right housing blocks 40R, 40L. Furthermore, the motion sensors 126 provided in the ear pads 43 at this time do not sense the surface of the desk, and hence detection results of all the motion sensors 126 are "OFF." When receiving the detection results of the pressure sensor 125 and the motion sensors 126, the processor 110 brings the speaker amplifier 119 into an active state.

If the headphone output is performed immediately before it, the headphone amplifier 118 is brought into an inactive state and the speaker amplifier 119 is brought into an active state. With this, switching from the headphone output state to the speaker output state is performed.

Note that, as the condition of detection of this desktop state, detection by the rotation detection sensors 127 that detect the rotation positions of the housing blocks 40R, 40L that the housing blocks 40R, 40L are located at the rotation positions in the desktop state may be added. Furthermore, the desktop state may be detected based on the detection results of the rotation detection sensors 127 and the detection results of all the motion sensors 126.

As described above, according to this embodiment, only by placing the headphone type acoustic apparatus 100 in a predetermined state, it is possible to automatically switch to the speaker output.

Next, an operation in the case of the wall-hanging state will be described.

Figure 14:
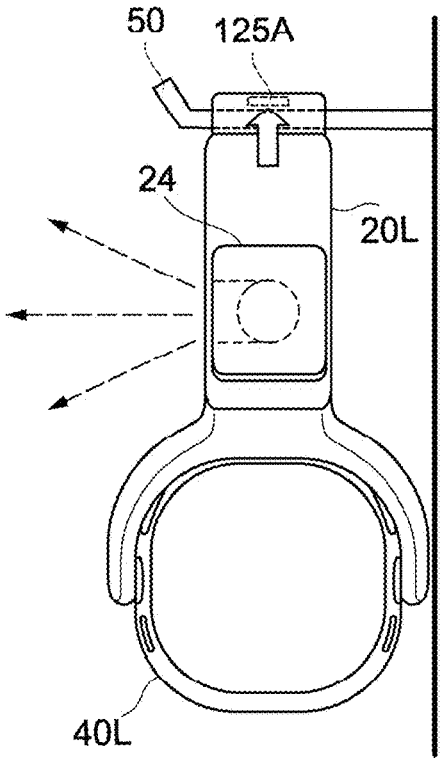
FIG. 14 A diagram showing a wall-hanging state of the headphone type acoustic apparatus of FIG. 1.

As shown in FIG. 14, the wall-hanging state as used herein means a state in which the portion of the headband 10 of the headphone type acoustic apparatus 100 is hung on a hook 50 fixed to a wall.

In this state, generation of pressures is detected by the pressure sensor 125A provided in the headband 10 and the detection circuit 128 and detection results thereof are output to the processor 110. The detection results of all the motion sensors 126 are "OFF." When receiving the detection results of the pressure sensor 125A and the motion sensors 126, the processor 110 brings the speaker amplifier 119 into an active state.

If the headphone output is performed immediately before it, the headphone amplifier 118 is brought into an inactive state and the speaker amplifier 119 is brought into an active state. With this, switching from the headphone output state to the speaker output state is performed.

The operations of estimating, based on the detection results of the sensors 125, 126, 127, the mounted state or the installed state of the headphone type acoustic apparatus 100 and switching between the headphone output and the speaker output have been described above. If a combination other than the combinations of the detection results of the sensors exemplified above is generated during audio reproduction, the processor 110 makes control to stop the reproduction as an unexpected state.

As described above, according to the headphone type acoustic apparatus 100 of this embodiment, it is possible to estimate, based on the detection results of the various sensors 125, 126, 127, the mounted state or the installed state of the headphone type acoustic apparatus 100 and automatically switch between the headphone output and the speaker output according to the estimated mounted state or installed state. With this, even if the user changes the use state while listening to music, the user can continue listening to the music.

<Modification 1>

Next, a modification example of the headphone type acoustic apparatus 100 of the first embodiment will be described.

As shown in FIGS. 13 and 14, if the headphone type acoustic apparatus 100 is used in the desktop state or the wall-hanging state, for emitting sound from the speaker unit 24 in an approximately horizontal direction, the sound spill ports 247 of the speaker units 24, 24 are provided facing a direction orthogonal or approximately orthogonal to the longitudinal direction of the slider blocks 20R, 20L.

However, the depth of insertion of the headband 10 into the slider blocks 20R, 20L is changed depending on the user's face or neck size or the like, and hence the position relationship between the ears of the user and the speaker units 24, 24 is also changed in the neck-mounted state. For example, as the user has a larger face or neck size, the speaker units 24, 24 become closer to the jaw of the user.

Figure 15:
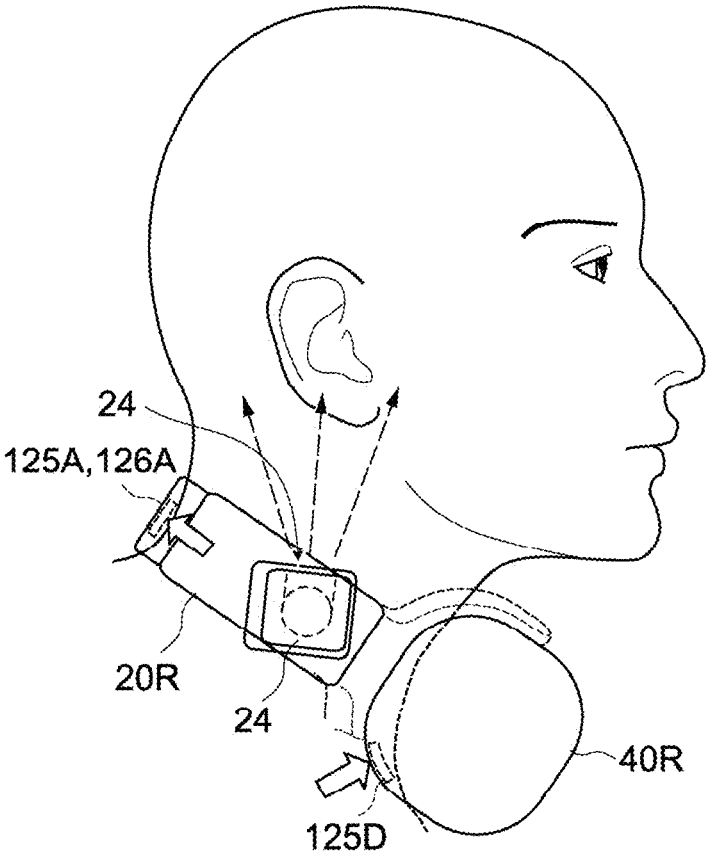
FIG. 15 A diagram showing Modification 1 of the headphone type acoustic apparatus of FIG. 1.

Therefore, a method in which the depth of insertion of the headband 10 into the slider blocks 20R, 20L is detected by an additional sensor (not shown) and, for example, as shown in FIG. 15, the speaker units 24, 24 are rotated according to this detection result such that the sound spill ports 247 of the speaker units 24, 24 are oriented to the ears of the user is conceivable.

In order to realize such an operation, for example, a detection means such as a sensor for detecting the depth of insertion of the headband 10 into the slider blocks 20R, 20L and a mechanism for rotating the speaker units 24, 24 in the slider blocks 20R, 20L are necessary. In the processor 110, a table in which the amount of insertion is made corresponding to the optimal amount of rotation is stored. Based on the amount of insertion detected by the detection means such as a sensor, the processor 110 refers the optimal amount of rotation in the table and outputs a control signal for rotating the speaker units 24, 24 by this amount of rotation to the mechanism.

<Modification 2>

In the headphone type acoustic apparatus 100 of the first embodiment, the headphone output and the speaker output are exclusively switched therebetween. In Modification 2, a reproduction mode on which the headphone output and the speaker output are performed at the same time is introduced.

Figure 16:
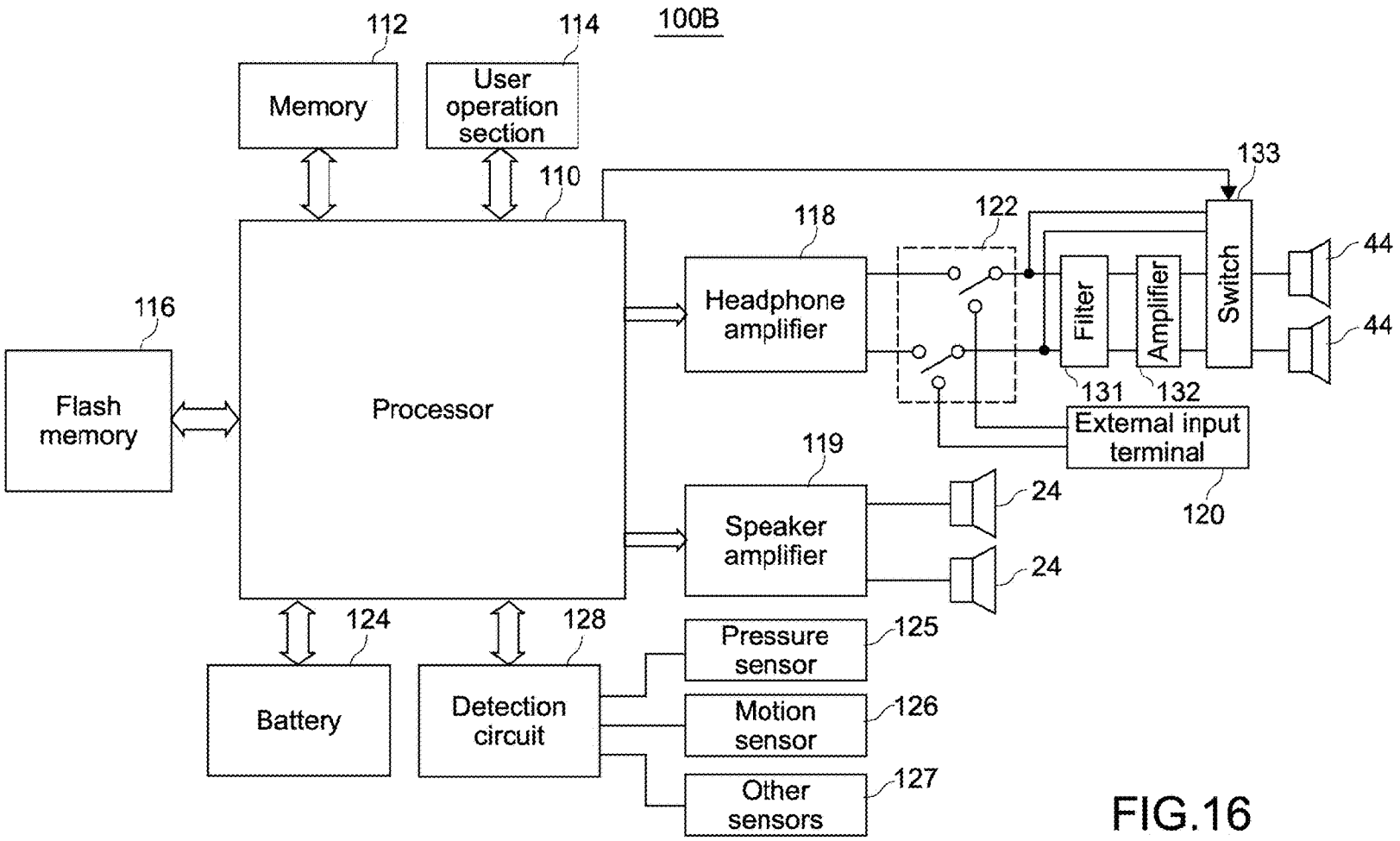
FIG. 16 A diagram showing an electrical configuration of a headphone type acoustic apparatus of Modification 2.

FIG. 16 is a diagram showing an electrical configuration of a headphone type acoustic apparatus 100B of Modification 2.

In order to increase the output of the headphone amplifier 118 to approximately the same level of the speaker output, a filter 131, an amplifier 132, and a switch 133 are connected between the output of the headphone amplifier 118 and the headphone units 44, 44.

Here, the filter 131 serves to subject an audio signal for the headphone output from the headphone amplifier 118 to surround processing. The amplifier 132 amplifies the audio signal output by the filter 131 to a speaker output level. According to a switching signal from the processor 110, the switch 133 switches between the output of the headphone amplifier 118 and the output of the amplifier 132 and supplies it to the headphone units 44, 44.

In this headphone type acoustic apparatus 100 B of Modification 2, the processor 110 brings the headphone amplifier 118 and the speaker amplifier 119 into an active state such that the headphone output and the speaker output are performed at the same time. The processor 110 brings the amplifier into an active state and controls the switch 133 using a switching control signal to select the output of the amplifier 132. With this, the audio signal output by the speaker amplifier 119 is output as sound by the speaker unit 24.

Meanwhile, the audio signal output by the headphone amplifier 118 is subjected to surround processing in the filter 131 and input into the amplifier 132. It is amplified to the speaker output level in the amplifier 132. Then, it is introduced into the headphone units 44, 44 via the switch 133. As a result, the sound at the speaker output level is output from the speaker unit 24 and the headphone units 44, 44 at the same time. With this, it is possible to enhance the surround feeling added to the headphone output.

In addition, according to an estimated mounted state such as the head-mounted state or neck-mounted state of the headphone type acoustic apparatus 100B, the processor 110 selects an optimal parameter for processing such as balance control between the headphone output and the speaker output and sound phase correction. With this, it is possible to further enhance the surround feeling.

<Modification 3>

Next, control of the headphone output and the speaker output during transition from the head-mounted state to the neck-mounted state will be described.

Figure 17:
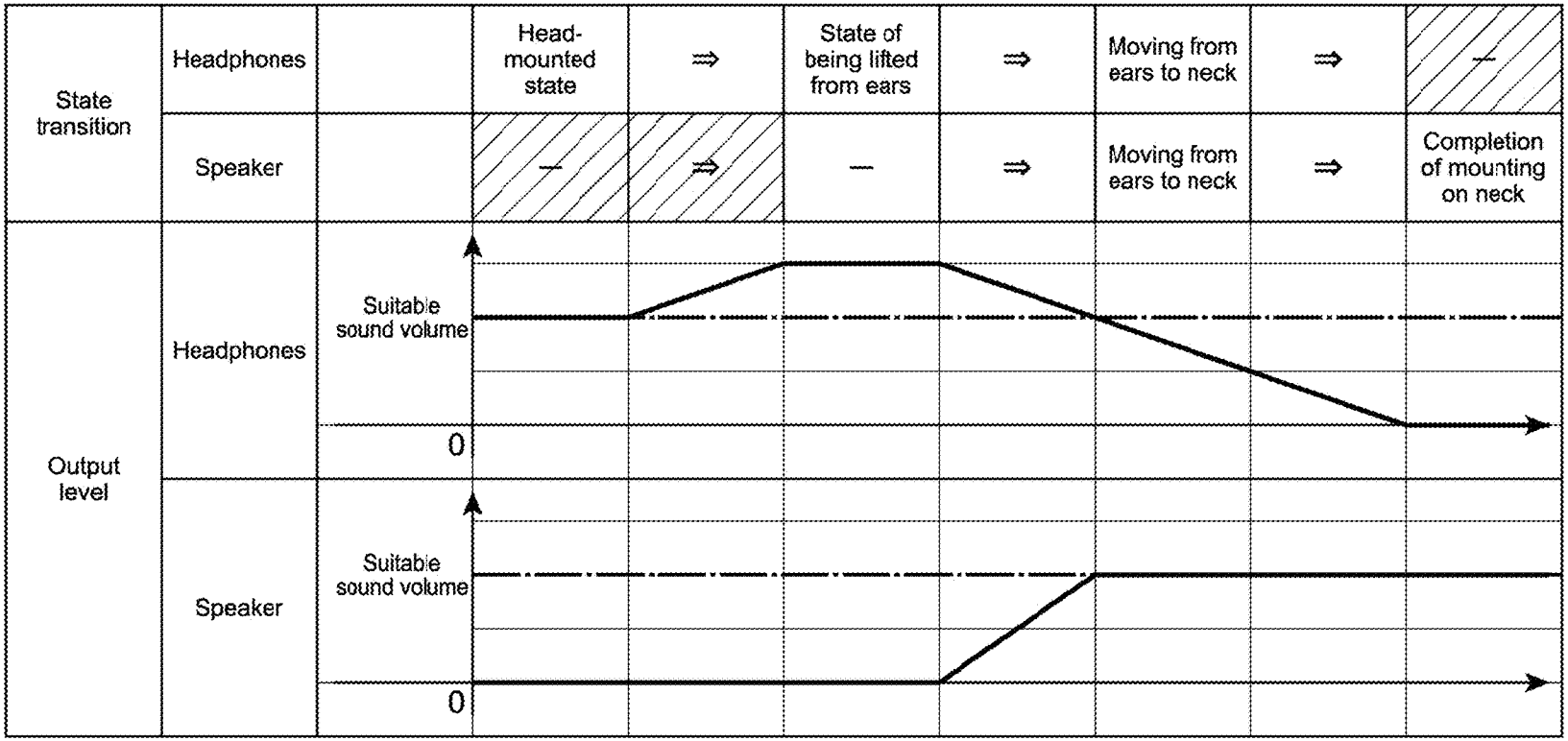
FIG. 17 A time chart showing changes in a headphone output and a speaker output when transitioning from the head-mounted state to the neck-mounted state in Modification 3.

FIG. 17 is a time chart of changes in the headphone output and the speaker output during transition from the head-mounted state to the neck-mounted state.

In FIG. 17, during head mounting, all the detection results of the pressure sensor 125A of the headband 10 and the pressure sensors 125B, 125C of the ear pads 43 of the left and right housing blocks 40R, 40L, for example, are "ON." Furthermore, all the detection results of the motion sensors 126A, 126B, 126C are also "ON."

As an initial operation of the transition from the head-mounted state to the neck-mounted state, the user removes the left and right housing blocks 40R, 40L from the users' ears. At this moment, the detection results of the pressure sensors 125B, 125C of the ear pads 43 of the left and right housing blocks 40R, 40L, for example, become "OFF." On the other hand, the outputs of the motion sensors 126B, 126C become values corresponding to distances from the human body. The detection circuit 128 has different thresholds for separately determining, based on the outputs of the motion sensors 126B, 126C, the state in which the headphone type acoustic apparatus is removed from the user and the transition state from the head-mounted state to the neck-mounted state. Therefore, during transition from the head-mounted state to the neck-mounted state, the detection circuit 128 outputs, based on the outputs of the motion sensors 126B, 126C, detection results indicating the transition state to the processor 110.

During transition from the head-mounted state to the neck-mounted state, the processor 110 gradually increases the headphone output over a certain time period and keeps this state for a certain time period.

Then, the processor 110 reduces it to "0" for a certain time period. These time periods are determined in advance in view of a time necessary for the transition from the head-mounted state to the neck-mounted state. Gradually increasing the headphone output for the certain time period is for preventing the volume of sound reaching the ears of the user from greatly changing as the left and right housing blocks 40R, 40L is being moved away from the ears of the user.

The processor 110 switches the speaker output to "ON" at a time when the certain time period for keeping the increased headphone output has elapsed. The processor 110 gradually increases the speaker output from "0" to suitable sound volume for a certain time period from that time and keeps the speaker output as it is. With this, it is possible to prevent the sound reaching the ears of the user from breaking off during transition from the headphone output to the speaker output.

Furthermore, a time when the headphone output becomes "0" during transition from the head-mounted state to the neck-mounted state is set to be after a time when it becomes suitable sound volume. It is for preventing a break of sound due to a sudden stop of the headphone output.

<Modification 4>

Figure 18:
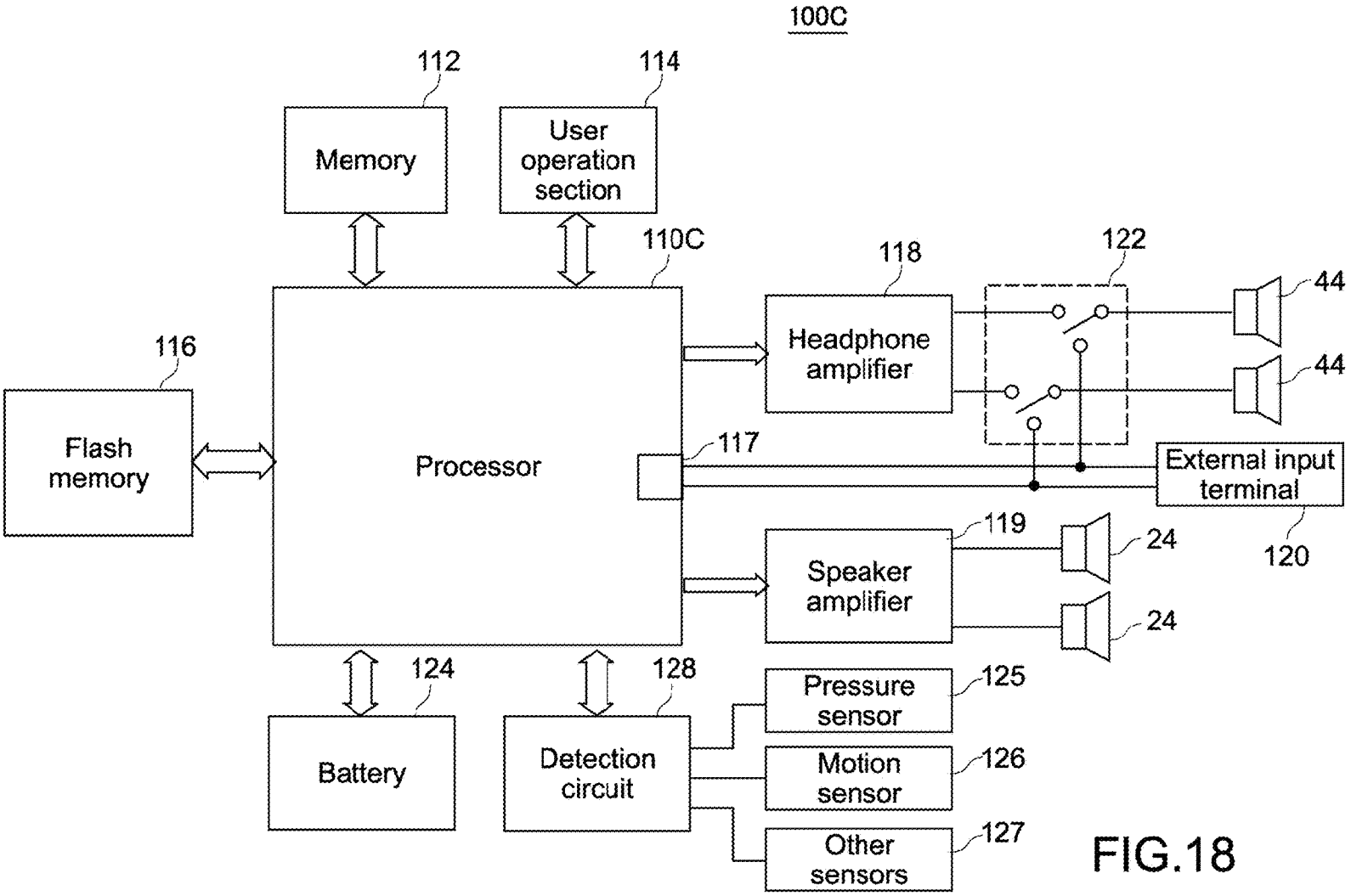
FIG. 18 A diagram showing an electrical configuration of a headphone type acoustic apparatus of Modification 4.

FIG. 18 is a diagram showing an electrical configuration of a headphone type acoustic apparatus 100C of Modification 4.

A processor 110C includes a line-in terminal 117 connected to the external input terminal 120. When the external device is connected to the external input terminal 120, the processor 110C recognizes it through the line-in terminal 117. Then, the processor 110C makes control to switch the input sources of the headphone units 44, 44 from the headphone amplifier 118 to the external device.

Note that the present technology may also take the following configurations.

(1) A headphone type acoustic apparatus, including:

a pair of housing blocks each including a headphone unit;

a headband section that supports the housing blocks at both ends and includes a pair of speaker units;

one or more sensors that obtain information for estimating a mounted state achieved by a user; and a control unit that estimates the mounted state based on outputs of the one or more sensors and controls, based on the estimated mounted state, outputs of the pair of headphone units and the pair of speaker units.

(2) The headphone type acoustic apparatus according to (1), in which the control unit determines, according to the estimated mounted state, whether the outputs of the pair of headphone units are turned on or the outputs of the pair of speaker units are turned on.

(3) The headphone type acoustic apparatus according to any one of (1) to (2), in which the estimated mounted state includes a first mounted state achieved by engagement with at least the pair of housing blocks and the headband section, and a second mounted state achieved by engagement with the headband section, and the control unit turns on at least the pair of headphone units when the first mounted state is estimated and turns on at least the pair of speaker units when the second mounted state is estimated.

(4) The headphone type acoustic apparatus according to any one of (1) to (3), in which the control unit turns on both of the pair of speaker units and the pair of headphone units when the second mounted state is estimated.

(5) The headphone type acoustic apparatus according to any one of (1) to (4), in which the detection section includes one or more pressure sensors and one or more motion sensors that are provided in a site that is capable of being brought into contact with the user in the pair of housing blocks and a site that is capable of being brought into contact with the user in the headband section in the first mounted state, and the control unit estimates the mounted state based on detection results of the one or more pressure sensors and the one or more motion sensors.

(6) The headphone type acoustic apparatus according to any one of (1) to (5), in which the control unit estimates, based on the detection results of the one or more pressure sensors and the one or more motion sensors, a transition state from the first mounted state to the second mounted state and, when the transition state is estimated, turns on the speaker unit before the second mounted state is estimated and keeps the headphone unit on until the second mounted state is estimated.

(7) The headphone type acoustic apparatus according to any one of (1) to (6), in which the control unit makes the output of the headphone unit larger than the output on the first mounted state for a certain time period after termination of the first mounted state is estimated, and gradually reduces the output after the certain time period has elapsed.

(8) The headphone type acoustic apparatus according to any one of (1) to (7), in which the control unit estimates, based on the detection results of the one or more pressure sensors and the one or more motion sensors, a first installed state in which the headphone type acoustic apparatus self-stands on the pair of housing blocks, and turns on the pair of speaker units.

(9) The headphone type acoustic apparatus according to any one of (1) to (8), in which the control unit estimates, based on the detection results of the one or more pressure sensors and the one or more motion sensors, a second installed state in which the headphone type acoustic apparatus is suspended with the headband section being a supporting point, and turns on the pair of speaker units.

DESCRIPTION OF SYMBOLS

10 head band
20R, 20L slider block
24 speaker unit
40R, 40L housing block
44 headphone unit
100 headphone type acoustic apparatus
110 processor
112 memory
114 user operation section
118 headphone amplifier
119 speaker amplifier
125 pressure sensor
126 motion sensor
127 rotation detection sensor
128 detection circuit

The invention claimed is:

1. A headphone type acoustic apparatus, comprising:

a pair of housing blocks that houses headphone units, wherein each housing block of the pair of housing blocks includes a headphone unit;

a headband section that is configured to support the pair of housing blocks at both ends, wherein the headband section includes a pair of speaker units that is different from the headphone units, and wherein the pair of speaker units is mounted on slider blocks of the headband section;

at least one sensor that is configured to obtain information to estimate a mounted state of the headphone type acoustic apparatus; and a control unit that is configured to:

estimate the mounted state based on output of the at least one sensor; and control, based on the estimated mounted state, first outputs of the headphone units and second outputs of the pair of speaker units.

2. The headphone type acoustic apparatus according to claim 1, wherein the control unit is further configured to determine, based on the estimated mounted state, at least one of the first outputs of the headphone units or the second outputs of the pair of speaker units that are turned on.

3. The headphone type acoustic apparatus according to claim 1, wherein the estimated mounted state includes:

a first mounted state achieved by engagement with at least the pair of housing blocks or the headband section, and a second mounted state achieved by engagement with the headband section, and the control unit is further configured to turn on, at least the headphone units based on the first mounted state or the pair of speaker units based on the second mounted state.

4. The headphone type acoustic apparatus according to claim 3, wherein the control unit is further configured to turn on the pair of speaker units and the headphone units, based on the second mounted state.

5. The headphone type acoustic apparatus according to claim 3, further comprising:

a detection section includes at least one pressure sensor and at least one motion sensor that are provided in a first site that is capable of being brought into contact with a user in the pair of housing blocks and a second site that is capable of being brought into contact with the user in the headband section in the first mounted state, and the control unit is further configured to estimate the mounted state based on detection results of the at least one pressure sensor and the at least one motion sensor.

6. The headphone type acoustic apparatus according to claim 5, wherein the control unit is further configured to estimate, based on the detection results of the at least one pressure sensor and the at least one motion sensor, a transition state from the first mounted state to the second mounted state and, turn on the pair of speaker units and the headphone units based on the second mounted state.

7. The headphone type acoustic apparatus according to claim 6, wherein the control unit is further configured to make the first outputs of the headphone units larger than output on the first mounted state for a time period based on termination of the first mounted state, and gradually reduce the output based on the time period.

8. The headphone type acoustic apparatus according to claim 5, wherein the control unit is configured to estimate, based on the detection results of the at least one pressure sensor and the at least one motion sensor, a first installed state in which the headphone type acoustic apparatus is configured to self-stand on the pair of housing blocks, and turn on the pair of speaker units.

9. The headphone type acoustic apparatus according to claim 5, wherein the control unit is further configured to estimate, based on the detection results of the at least one pressure sensor and the at least one motion sensor, a second installed state in which the headphone type acoustic apparatus is suspended with the headband section as a supporting point, and turn on the pair of speaker units.

10. A control method, comprising:

in a headphone type acoustic apparatus that includes:

a pair of housing blocks that houses headphone units, wherein each housing block of the pair of housing blocks includes a headphone unit, a headband section that is configured to support the pair of housing blocks at both ends, wherein the headband section includes a pair of speaker units that is different from the headphone units, and wherein the pair of speaker units is mounted on slider blocks of the headband section, at least one sensor, and a control unit:

obtaining information, by the at least one sensor to estimate a mounted state of the headphone type acoustic apparatus;

estimating, by the control unit, the mounted state based on the information obtained by the at least one sensor; and controlling, based on the estimated mounted state, first outputs of the headphone units and second outputs of the pair of speaker units.

* * * * *